US010870931B2

(12) United States Patent
Morris

(10) Patent No.: US 10,870,931 B2
(45) Date of Patent: Dec. 22, 2020

(54) WOVEN TEXTILE FABRIC AND INNERDUCT HAVING MULTIPLE-INSERTED FILLING YARNS

(71) Applicant: Milliken & Company, Spartanburg, SC (US)

(72) Inventor: David D. Morris, Newnan, GA (US)

(73) Assignee: Milliken & Company, Spartanburg, SC (US)

( * ) Notice: Subject to any disclaimer, the term of this patent is extended or adjusted under 35 U.S.C. 154(b) by 132 days.

(21) Appl. No.: 16/137,085

(22) Filed: Sep. 20, 2018

(65) Prior Publication Data

US 2019/0024271 A1 Jan. 24, 2019

Related U.S. Application Data

(63) Continuation of application No. 12/956,502, filed on Nov. 30, 2010, now abandoned.

(51) Int. Cl.

| | |
|---|---|
| ***F16L 11/00*** | (2006.01) |
| ***D03D 3/00*** | (2006.01) |
| ***D03D 13/00*** | (2006.01) |

(52) U.S. Cl.

CPC ..... *D03D 3/005* (2013.01); *D03D 13/004* (2013.01); *D03D 13/008* (2013.01)

(58) Field of Classification Search

CPC ..... F16L 11/22; F16L 11/10; F16L 11/005; F16L 11/02

USPC ..... 138/115, 116, 117, 123, 128, 108

See application file for complete search history.

(56) References Cited

U.S. PATENT DOCUMENTS

| | | | | | |
|---|---|---|---|---|---|
| 3,266,529 | A * | 8/1966 | Bunger | D03D 1/06 | 139/384 R |
| 3,473,885 | A * | 10/1969 | Stanley | D03D 23/00 | 8/120 |
| 3,537,488 | A * | 11/1970 | Leboeuf | D03D 11/00 | 139/415 |
| 3,556,165 | A * | 1/1971 | Zmatlik | D03D 23/00 | 139/383 R |
| 3,911,200 | A | 10/1975 | Simons et al. | 174/36 | |
| 4,041,988 | A * | 8/1977 | Benzakein | A44B 19/54 | 139/116.1 |
| 4,281,211 | A | 7/1981 | Tatum et al. | 174/36 | |
| 4,582,093 | A | 4/1986 | Hubbard | 138/111 | |

(Continued)

FOREIGN PATENT DOCUMENTS

| | | |
|---|---|---|
| DE | 102 04 019 | 8/2003 |
| EP | 1 254 980 | 11/2002 |

(Continued)

OTHER PUBLICATIONS

Patent Cooperation Treaty PCT International Search Report, dated Oct. 23, 2012, International Application No. PCT/US2011/048790, International Filing date, Aug. 23, 2011.

*Primary Examiner* — James F Hook

(74) *Attorney, Agent, or Firm* — Cheryl J. Brickey

(57) ABSTRACT

An innerduct for segregating cables in a conduit is provided wherein the innerduct is constructed from one or more strip-shaped lengths of a woven textile fabric and configured to provide multiple longitudinal compartments for the cables, and the textile fabric has a warp of monofilament yarn ends and a filling of a combination of monofilament and multifilament yarn picks, with the multifilament yarn picks being multiple-inserted yarns.

9 Claims, 6 Drawing Sheets

(56) References Cited

U.S. PATENT DOCUMENTS

| | | | | |
|---|---|---|---|---|
| 4,602,763 | A | 7/1986 | Gaylin | 254/134.3 FT |
| 4,660,605 | A * | 4/1987 | Koch | B60R 22/12 139/117 |
| 4,761,194 | A | 8/1988 | Pithouse et al. | 156/86 |
| 4,862,922 | A | 9/1989 | Kite, III | 138/119 |
| 4,929,478 | A | 5/1990 | Conaghan et al. | 428/35.1 |
| 5,016,859 | A | 5/1991 | Zimmer et al. | 254/134 R |
| 5,027,864 | A | 7/1991 | Conti | 138/177 |
| 5,442,136 | A | 8/1995 | Allen | 174/95 |
| 5,513,149 | A | 4/1996 | Salmi et al. | 138/123 |
| 5,587,115 | A | 12/1996 | Allen | 264/124 |
| 5,789,711 | A | 8/1998 | Gaeris et al. | 174/113 C |
| 5,843,542 | A | 12/1998 | Brushafer | 428/36.1 |
| 5,969,295 | A | 10/1999 | Boucino et al. | 174/113 C |
| 6,178,278 | B1 | 1/2001 | Keller et al. | 385/109 |
| 6,251,201 | B1 | 6/2001 | Allen | 156/47 |
| 6,262,371 | B1 | 7/2001 | Allen | 174/68.1 |
| 6,304,698 | B1 | 10/2001 | Morris | 385/100 |
| 6,398,190 | B1 | 6/2002 | Li | 254/134.4 |
| 6,421,485 | B2 | 7/2002 | Morris | 385/100 |
| 6,471,440 | B1 | 10/2002 | Scheiwiller | 404/39 |
| 6,508,276 | B2 * | 1/2003 | Radlinger et al. | F16L 11/02 138/124 |
| 6,571,833 | B1 | 6/2003 | McLarty, III et al. | 138/116 |
| 6,671,440 | B2 * | 12/2003 | Morris | G02B 6/4459 174/19 |
| 6,718,100 | B2 | 4/2004 | Morris | 385/100 |
| 6,787,491 | B2 * | 9/2004 | Braekevelt | B29C 70/22 428/137 |
| 6,876,797 | B2 | 4/2005 | Morris | 385/100 |
| 6,886,601 | B2 | 5/2005 | Allen | 138/107 |
| 6,963,031 | B2 | 11/2005 | Gladfelter | 174/74 A |
| 7,078,615 | B2 | 7/2006 | Gladfelter | 174/361 |
| 7,085,455 | B2 | 8/2006 | Morris | 385/100 |
| 7,085,458 | B2 | 8/2006 | Morris | 385/110 |
| 7,174,074 | B2 | 2/2007 | Morris | 385/100 |
| 7,188,642 | B2 * | 3/2007 | James | G02B 6/4459 139/383 R |
| 7,319,802 | B2 | 1/2008 | Morris | 385/109 |
| 7,621,505 | B2 | 11/2009 | Hamrick | 254/134.3 FT |
| 7,754,971 | B2 | 7/2010 | Bedingfield et al. | 174/117 |
| 7,799,997 | B2 | 9/2010 | Bedingfield et al. | 174/93 |
| 8,387,954 | B2 | 3/2013 | Allen | 254/134 |
| 8,809,682 | B2 | 8/2014 | Hepfinger et al. | 174/95 |
| 8,925,592 | B2 * | 1/2015 | Itoh | B60R 16/02 138/123 |
| 2003/0015248 | A1 | 1/2003 | Itoh | 139/420 R |
| 2003/0142933 | A1 | 7/2003 | Morris | 385/100 |
| 2003/0185527 | A1 * | 10/2003 | Morris | F16L 9/19 385/100 |
| 2004/0081411 | A1 | 4/2004 | Gladfelter et al. | 385/100 |
| 2005/0185902 | A1 | 8/2005 | James et al. | 385/100 |
| 2006/0016507 | A1 | 1/2006 | Baer | 139/383 R |
| 2006/0117807 | A1 * | 6/2006 | Reiter | D03D 1/0005 66/196 |
| 2008/0054236 | A1 | 3/2008 | Morris | 254/134.4 |
| 2008/0264669 | A1 | 10/2008 | Bedingfield et al. | 174/97 |
| 2009/0218002 | A1 | 9/2009 | Kashihara | 139/443 |
| 2012/0073854 | A1 | 3/2012 | Allen | 174/68.1 |
| 2012/0132309 | A1 * | 5/2012 | Morris | D03D 3/005 138/115 |

FOREIGN PATENT DOCUMENTS

| | | |
|---|---|---|
| EP | 1 385 246 | 1/2004 |
| JP | 2005-116534 | 5/2006 |
| WO | WO 2004/020888 | 3/2004 |
| WO | WO 2008/027467 | 3/2008 |
| WO | WO 2008/070819 | 6/2008 |

* cited by examiner

| NAME | FILLING YARN SEQUENCE (REPEAT) | REPEAT | PPI |
|---|---|---|---|
| EXAMPLE 1 | 520 / 2 x DI 681 / 350 / 2 x DI 681 | 6 | 18 |
| COMPARATIVE EXAMPLE 2 | 520 / 2 x 1100d / 350 / 2 x 1100d | 6 | 18 |

520d MONO N6

2x300d (681d) TEXTURED PET ( DI=DOUBLE INSERTION )

350d MONO N6

1100d TEXTURED PET

*FIG. 5*

WOVEN TEXTILE FABRIC AND INNERDUCT HAVING MULTIPLE-INSERTED FILLING YARNS

RELATED APPLICATIONS

This application is a continuation of co-pending U.S. patent application Ser. No. 12/956,502, filed on Nov. 30, 2010, which is herein incorporated by reference in its entirety.

TECHNICAL FIELD

This invention relates generally to a textile fabric useful in the construction of innerduct structures used for positioning cables in conduit, and in particular to a woven textile fabric and innerduct having multiple-inserted filling yarns.

BACKGROUND

The use of a flexible innerduct structure made of a woven textile fabric, which can be inserted into a conduit, is disclosed in Morris, U.S. Pat. No. 6,304,698 B1 and Allen, U.S. Pat. No. 6,251,201 B1. The innerduct serves multiple functions, including segregating individual cables into compartments or channels within the innerduct, to maximize the number of cables that may be positioned in a conduit, and facilitating insertion of cables into the conduit by preventing cable-against-cable friction and providing a tape or rope inside each compartment of the innerduct, for pulling the cable into the conduit.

In addition to the foregoing functions, a key measure of the utility of textile fabric innerducts is the pulling tension required to draw a cable through the innerduct, when a cable is introduced into a conduit. It is believed that reduced stiffness, in particular, lower rigidity in the filling direction of the woven textile fabric, allows the compartments forming the innerduct to be more readily opened when a cable is pulled through, thereby reducing the pulling tension.

An innerduct fabric construction for lowering the pulling tension required to install cables within compartments of the innerduct is disclosed in Bedingfield et al., US Patent Application No. 20088/0264669 A1. The innerduct structure is formed from a woven textile fabric having monofilament warp yarns and an alternating pattern of monofilament and multifilament filling yarns. The disclosed woven textile fabrics may be employed in various innerduct structures, including a "shared wall configuration" and a "tear-drop configuration."

Despite the advances made in lowering the pulling tension required to install cables in woven textile fabric innerduct structures, further improvements are desirable. Nevertheless, attempts to further reduce the pulling tension have met with numerous obstacles related to the strength and stability of the innerduct structures. For example, reducing the rigidity in the filling direction of the textile fabric by decreasing the number of filling yarns per inch has been found to compromise the seam strength of the innerduct, filling tensile strength, filling tear strength, abrasion resistance, and/or processability of the fabric. Thus, unless an innerduct structure constructed from a textile fabric can meet the strength and stability requirements, it is unlikely to perform satisfactorily in conduit applications, regardless of whether the pulling tension is reduced.

BRIEF SUMMARY

In order to meet the aforementioned objective of lowering the pulling tension required to install a cable in a woven textile fabric innerduct, without compromising the strength and stability of the innerduct structures, at least a portion of the yarns in the filling of the textile fabric are multiple-inserted multifilament yarns. Without being bound to a particular theory, it is believed that the multiple-inserted multifilament yarns provide the bulk necessary to meet the strength and stability requirements of an innerduct structure, while providing the flexibility necessary to lower filling rigidity, and thus, lower the pulling tension required to install a cable.

In one embodiment of the invention, a woven textile fabric is provided having a warp comprised of monofilament yarn ends and a filling comprised of a combination of monofilament and multifilament yarn picks, wherein at least a portion of the multifilament yarn picks are multiple-inserted. The fabric may include one or more of the following features: from 12 to 28 picks per inch ("ppi"), textured, polyester multifilament yarns and double-inserted multifilament yarns.

The invention further includes an innerduct structure made from a woven textile fabric wherein at least a portion of the yarns in the filling of the textile fabric are multiple-inserted multifilament yarns. The innerduct structure may be a shared wall configuration or a tear-dropped configuration, as hereinafter described. The innerduct may have 1, 2, 3 or more longitudinal compartments or channels, each capable of enveloping at least one cable.

Also included within the scope of the present invention is an apparatus comprised of a conduit and one or more innerducts positioned within and extending along the length of the conduit, wherein the innerduct is constructed from a woven textile fabric and wherein at least a portion of the yarns in the filling of the textile fabric are multiple-inserted multifilament yarns. A cable may be positioned within a longitudinal compartment in the innerduct. In one embodiment of the invention, the innerduct is provided with multiple compartments, and at least two of the compartments have cables inserted therein.

BRIEF DESCRIPTION OF THE DRAWINGS

FIG. 5 is a schematic diagram showing the filling yarn sequences in Example 1 and Comparative Example 2.

DETAILED DESCRIPTION

Figure 1:
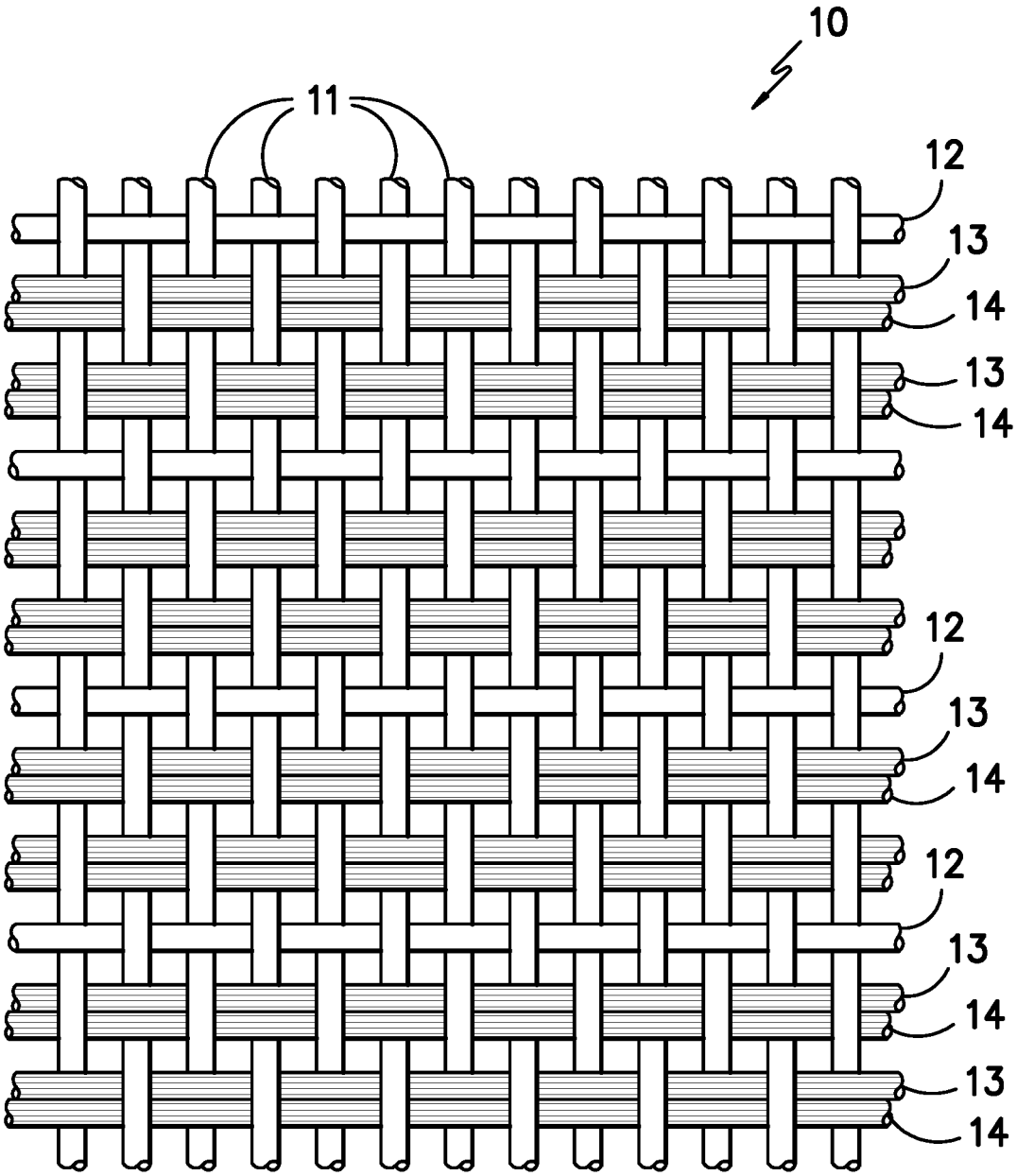
FIG. 1 is top view of the textile fabric of the present invention having an alternating pattern (1:2) of monofilament yarns and double-inserted multifilament yarns in the filling direction.

Without intending to limit the scope of the invention, the preferred embodiments and features are hereinafter set forth. All of the United States patents and patent applications cited herein are incorporated by reference.

The terms "pick," "picks," "picks per inch" and "ppi" are intended to refer to (a) one filling yarn carried through a shed formed during the weaving process and interlaced with the warp yarns; and (b) two or more filling yarns carried through a shed during the weaving process, either separately or together, and interlaced with the warp yarns. Thus, for the purposes of determining the picks per inch of a woven textile fabric, multiple-inserted filling yarns are counted as a single pick.

The terms "multiple-insertion" and "double-insertion" are intended to include (a) multiple filling yarns inserted in the shed of the loom together; (b) multiple filling yarns inserted separately, while the shed of the loom remains the same; and (c) multiple filling yarns inserted separately, where the shed of the looms remains substantially the same, that is, the position of 25% or less of the warp yarns are changed between insertions of the yarns.

In its broadest sense, the present invention is directed to a woven textile fabric in which at least a portion of the filling yarns are multiple-inserted multifilament yarns. In various embodiments of the invention, the woven textile fabric may be constructed with at least one-fourth of the picks being multiple-inserted multifilament yarns, at least one-third of the picks being multiple-inserted multifilament yarns, or even at least one-half of the picks being multiple-inserted multifilament yarns. Woven textile fabrics in which the multiple-inserted multifilament yarns are double-inserted have been found to be particularly useful for making innerduct structures. The innerduct structure can be placed in a conduit and used for segregating cables within the conduit.

Textile Fabric Construction

The woven textile will typically be a plain weave, although other constructions, such as twill or satin weaves, are within the scope of the invention. The individual warp yarns ("ends") are selected to provide high tenacity and low elongation at peak tensile load. By way of example, the warp yarns may be selected from polyesters, polyolefins, such as polypropylene, polyethylene and ethylene-propylene copolymers, and polyamides, such as nylon and aramid, e.g. Kevlar®. Yarns having a peak elongation at peak tensile load of 45% or less, preferably 30% or less, may be used. Monofilament yarns, including bi- and multi-component yarns, have been found to be particularly useful in innerduct applications. Multifilament yarns may also be used in the warp. Warp yarns having a denier of from 350 to 1,200, preferably 400 to 750, may be employed. The end count (yarns per inch in the warp) may range from 25 to 75 ends per inch, preferably from 35 to 65 ends per inch. In one embodiment of the invention a plain weave textile fabric having 35 to 65 ends per inch of 400 to 750 denier monofilament polyester warp yarns is provided.

By selecting warp yarns having a relatively low elongation at peak tensile load, it is possible to minimize lengthwise elongation of the innerduct structure during installation of the innerduct in a conduit, thereby avoiding "bunching" of the innerduct. Additionally, the elongation potential in the warp direction of the textile fabric incorporated into an innerduct can be minimized by reducing the warp crimp during the weaving process. For example, the warp crimp may be reduced by increasing the tension on the warp yarns during weaving to achieve a warp crimp of less than 5%, as measured by ASTM D3883—Standard Test Method for Yarn Crimp and Yarn Take-Up in Woven Fabrics. Reducing the warp crimp in the fabric, especially a plain weave fabric, results in an increase in the crimp of the filling yarn, which has the further advantage of increasing the seam strength along the longitudinal edges of the sections of fabric used to construct the innerduct.

At least a portion of the filling yarns are multiple-inserted multifilament yarns. Each multifilament yarn is made of continuous filaments of a synthetic polymer. By way of example, the yarns may be selected from polyesters, polyolefins, such as polypropylene, polyethylene and ethylene-propylene copolymers, and polyamides, such as nylon and aramid. Each yarn may contain from 30 to 110 individual filaments, typically from 50 to 90 individual filaments, and the denier of the yarn may range from 200 to 1,000, typically from 500 to 800. Each multifilament yarn may be constructed of one, two or more plies.

The textile fabric may be woven on a conventional loom, such as rapier, air jet or water jet looms. The multiple-inserted multifilament yarns may be inserted in the shed of the loom individually or together.

The multifilament yarns may be textured yarns, that is, yarns which have been treated to provide surface texture, bulk, stretch and/or warmth. Texturing may be accomplished by any suitable method, as is known to those skilled in the art. Of particular interest are textured polyester yarns. By way of example, the polyester may be polyethylene terephthalate. Other examples of suitable polyester polymers for use in fiber production may be found in U.S. Pat. No. 6,395,386 B2.

In one embodiment of the invention, the fill yarns are provided in an alternating arrangement of monofilament yarns and multifilament yarns, as disclosed in US Patent Application No. 20088/0264669 A1. The phrase "alternating arrangement" refers to a repeating pattern of picks of monofilament to multifilament yarns. By way of example, the arrangement of monofilament to multifilament yarns may be 1:1, 1:2, 1:3, 2:3, 3:4, or 3:5. It can be understood that some or all of the multifilament yarn picks may be multiple-inserted multifilament yarns.

Bi- or multi-component yarns of various configurations are intended to be included within the definition of monofilament yarns used in the alternating pattern in the filling direction of the fabric.

When monofilament yarns are included in the filling direction of the textile fabric, the monofilament filling yarns may be selected from polyesters, polyolefins, such as polypropylene, polyethylene and ethylene-propylene copolymers, and polyamides, such as nylon, particularly nylon 6, and aramid. Monofilament filling yarns having a denier of from 200 to 850, preferably 300 to 750, may be employed. In one embodiment of the invention, two different size monofilament yarns are incorporated into the alternating pattern in the filling direction. For example, one of the monofilament filling yarns may have a denier of less than 435 and the other monofilament filling yarn may have a denier greater than 435.

The pick count (picks per inch in the filling) may range from 12 to 28 picks per inch. One of the advantages of the present invention is that it is possible to provide a fabric at the lower end of the pick count range, in order to reduce filling rigidity and reduce material and manufacturing costs. Accordingly, woven textile fabrics having a pick count in the range of 12 to 22 picks per inch are preferred. In one embodiment of the invention a plain weave textile fabric having from 14 to 22 picks per inch of an alternating pattern of nylon monofilament and double-inserted textured polyester monofilament is provided.

Referring to FIG. 1, plain-weave textile fabric 10 has monofilament warp yarns 11, and an alternating pattern (1:2)

of monofilament filling yarns 12 and double-inserted multifilament yarns 13 and 14 in the filling direction.

Innerduct Construction

The innerduct structure is constructed from one or more strip-shaped lengths of woven textile fabric configured to create at least one flexible, longitudinal compartment or channel for enveloping a cable. The strip-shaped lengths of fabric are positioned so that the warp yarns extend along the length of the innerduct and the filling yarns are aligned perpendicular to the length of the innerduct.

The one or more strip-shaped lengths of fabric may be joined together to form one, two, three or more compartments in a single innerduct structure, with each of the compartments extending along the length of the innerduct. The innerduct may be configured from a single, strip-shaped length of fabric, which is folded lengthwise, that is, the filling yarns are folded. Alternatively, the innerduct may be configured from multiple, strip-shaped lengths of fabric, which optionally may be folded lengthwise, depending upon the particular design. The term "configured" includes both the spatial arrangement of the one or more lengths of textile fabric, as well as the means to affix the length(s) of textile fabric in the desired spatial orientation. The innerduct may be conveniently affixed in the desired orientation by sewing the one or more strip-shaped lengths of fabric, for example, along one or two seams. Additional methods of affixing the one or more lengths of fabric to construct the innerduct include stapling or riveting the fabric at intervals along the length, ultrasonic welding, or fastening the fabric with a hot melt or solvent based adhesive. The textile fabric may also be provided with relatively low temperature melting fibers, which can be melted and allowed to cool, thereby fusing the innerduct and preventing the structure from unraveling.

Examples of particular innerduct configurations, which are useful in conjunction with the present invention may be found in various references, including U.S. Pat. Nos. 6,304,696 B1 and 6,571,833 B1, and US Patent Applications Nos. 2008/0054236 A1 and 2008/0264669 A1. Generally, the configurations fall into two categories, the tear-drop configuration and the shared-wall configuration.

Figure 2:
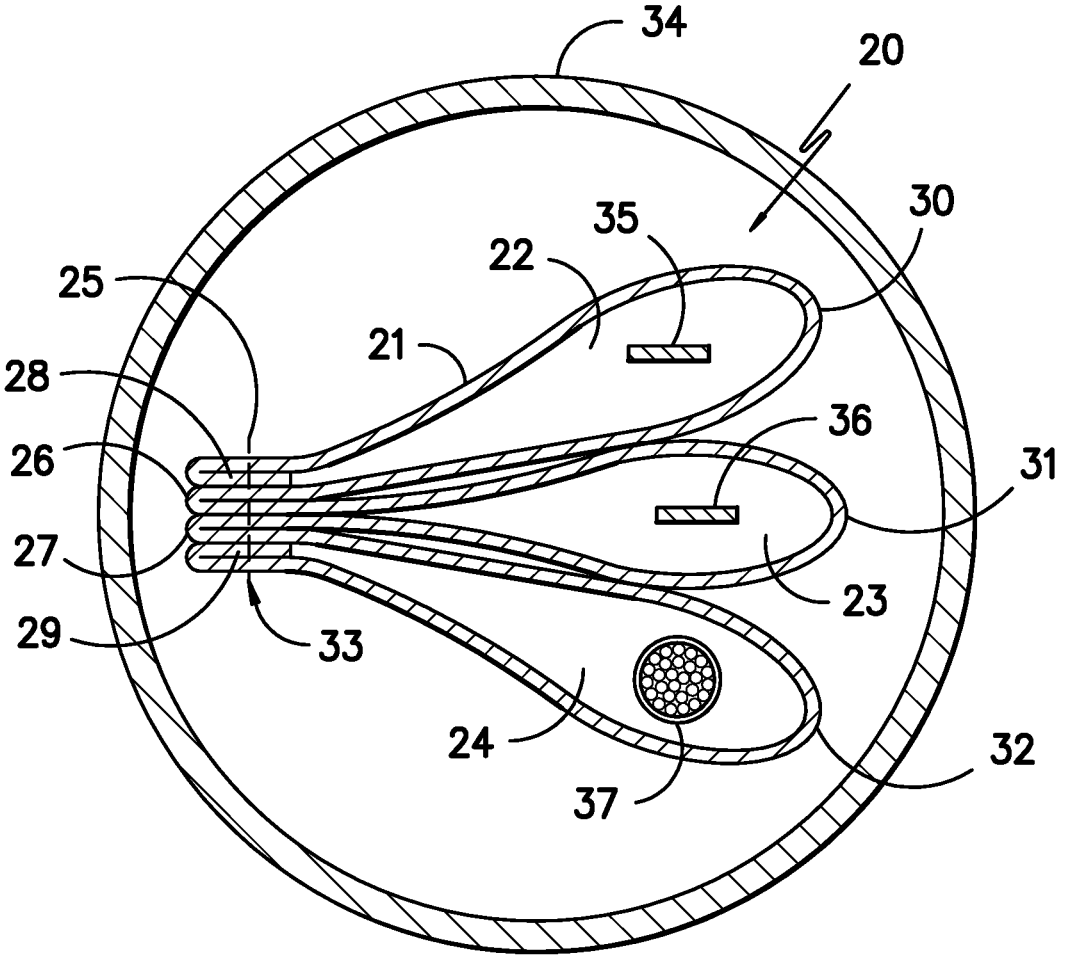
FIG. 2 is a side view of an innerduct having a tear-drop configuration, with the innerduct positioned in a conduit.
Figure 3A:
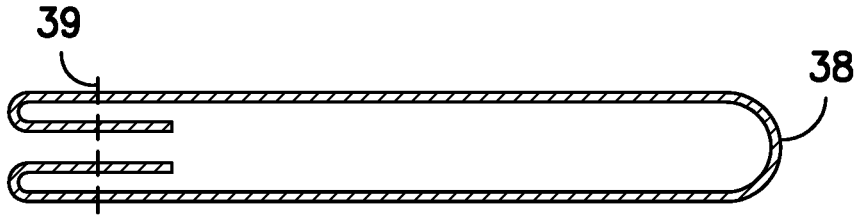
FIGS. 3A-3F are schematic views of possible folding and seaming arrangements for innerducts having a tear-drop configuration constructed from multiple strip-shaped lengths of fabric.
Figure 3B:
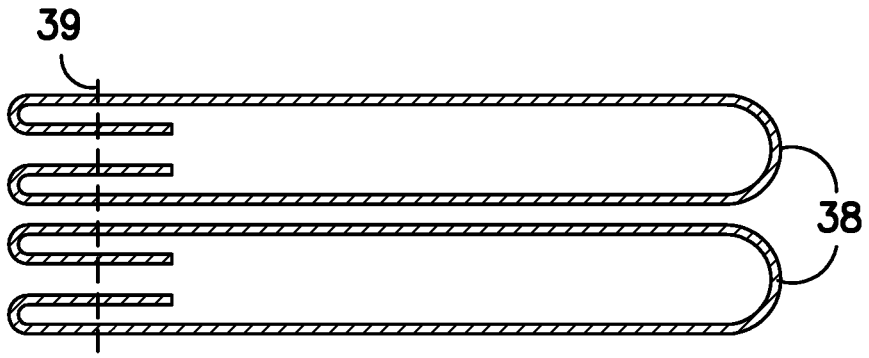
Figure 3C:
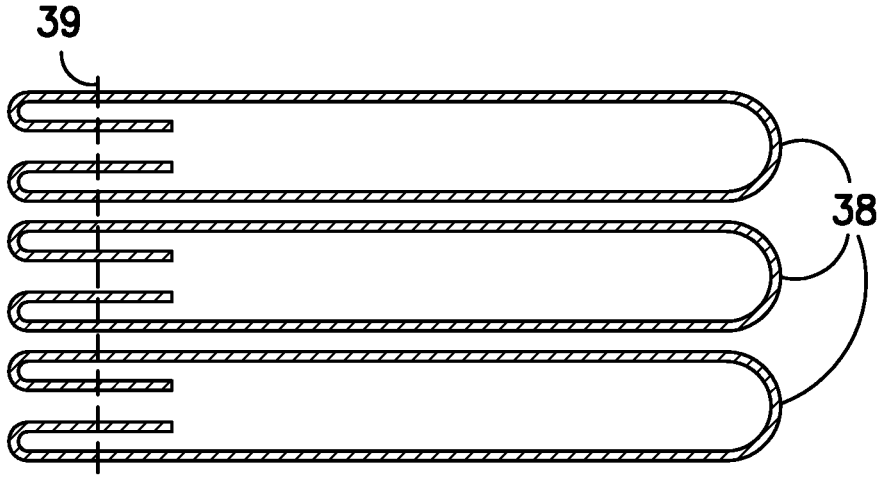
Figure 3D:
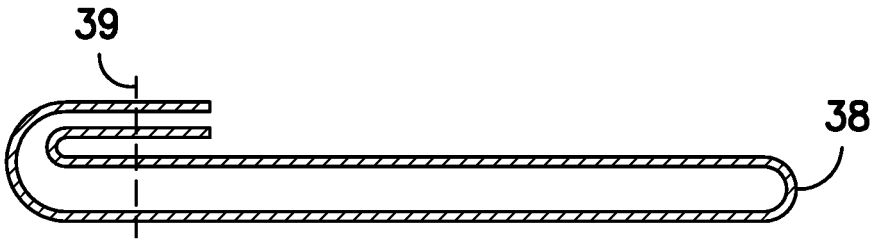
Figure 3E:
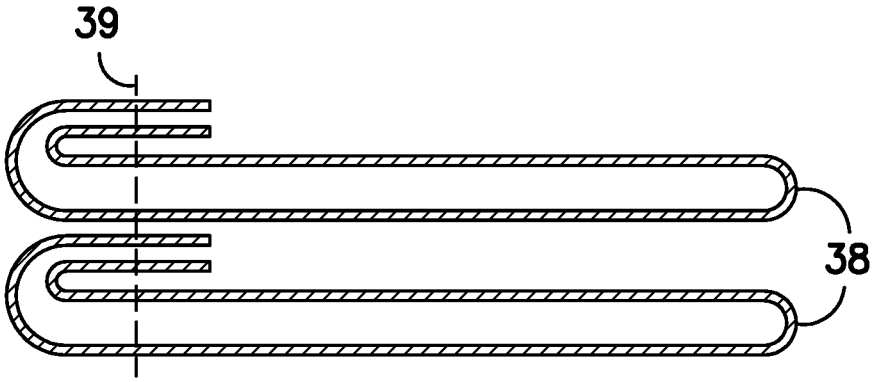
Figure 3F:
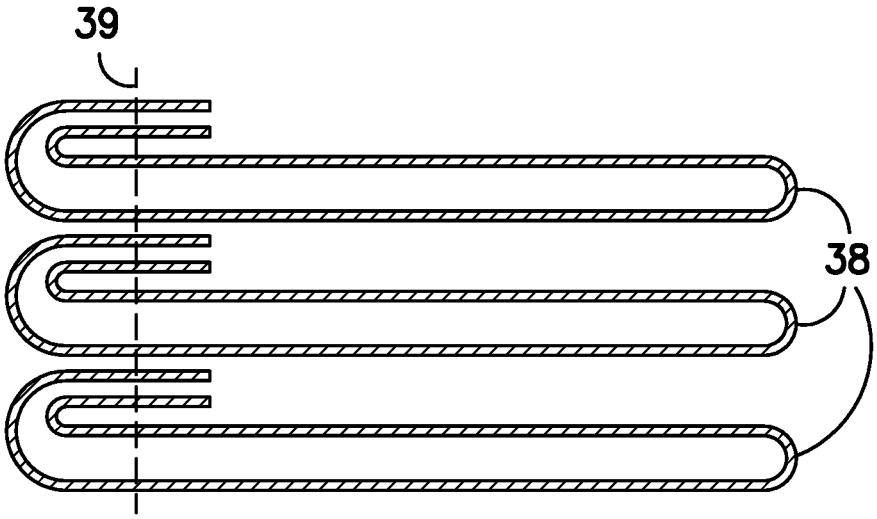

An example of an innerduct having a tear-drop configuration, with three compartments for enveloping a cable, is shown in FIG. 2 and identified as 20. A single strip-shaped length of textile fabric 21 is folded to create three individual compartments 22, 23 and 24. The innerduct is constructed with a common seam 25, which secures the folds 26 and 27, as well as the cut edges along the length of the fabric 28 and 29, which are folded under, to improve seam strength and reduce friction. The tear-drop shaped innerduct 20 has lobes 30, 31 and 32, opposite the fastened edge 33, which are formed by folding textile fabric 21. The innerduct 20 is shown installed in conduit 34. Innerduct 20 is shown with pull lines 35 and 36 in compartments 22 and 23, respectively, and with cable 37 in compartment 24.

In alternative embodiments, a multi-compartment tear-dropped shaped innerduct may be constructed from multiple strip-shaped lengths of textile fabric, the cut edges of which are fastened together, for example, by a common seam. Referring to FIGS. 3A-3F, strip-shaped lengths of fabric 38 are folded to create 1, 2 or 3 compartments and affixed by seam 39. Optional tear-drop configurations are disclosed in US Patent Applications No. 2008/0264669 A1. Regardless of whether one or more strip-shaped lengths of fabric are used to construct the tear-drop shaped innerduct, a common feature is that each of the compartments is characterized by a strip-shaped length of fabric being fastened to itself along a length of the fabric and a lobe, formed by folding the fabric, opposite the location where the fabric is fastened.

Figure 4:
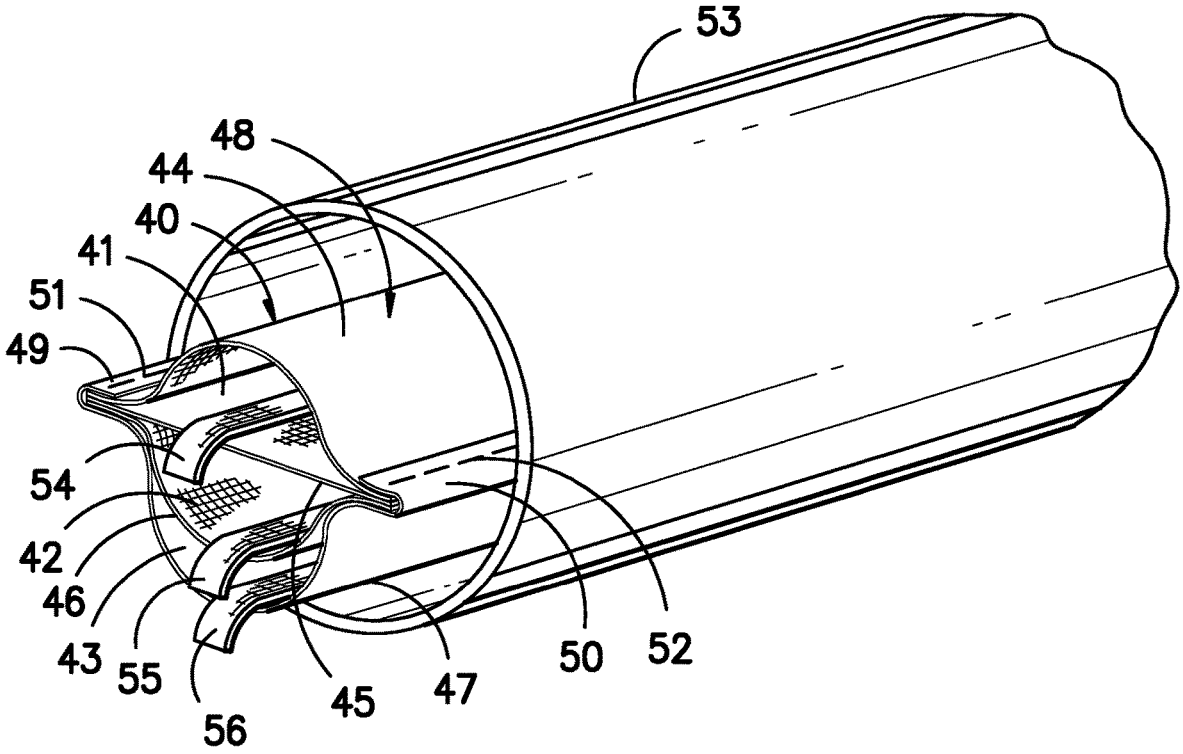
FIG. 4 is a perspective view of an innerduct having a shared-wall configuration, with the innerduct positioned in a conduit.

An example of an innerduct having a shared wall configuration is shown in FIG. 4 and identified as 40. This configuration is characterized by adjacent compartments or channels sharing a common layer, or wall, between them. Each innerduct 40 defines of a plurality of compartments 41, 42 and 43, which are formed by interconnecting strip-shaped lengths 44, 45, 46 and 47 of textile fabric 48, along their opposite, side edges extending along the length of innerduct 40. Such joining is preferably accomplished by overlapping the edge portions 49 and 50 of the lower length of fabric 47, over the side edge portions of the other lengths of fabric, after which all of the lengths of fabric: 44, 45, 46 and 47 are connected together by sewing, indicated by seams 51 and 52.

In one embodiment of the invention, the innerduct 40 is constructed in the following manner. The fabric used to create the innerduct 40 is slit lengthwise (along the warp, or machine, direction) into panels of varying width. The center length of fabric 45 is the narrowest, the next adjacent lengths 44 and 46 are wider, and length 47 is the widest. The innerduct 40 is manufactured in long lengths for insertion in previously installed conduits 53. For example, successive lengths of fabric may be joined together end-to-end, to provide an innerduct with a length that may extend, for example, three to four miles. In an alternative embodiment, the shared-wall configuration innerduct may be constructed from a single strip-shaped length of fabric, which is folded multiple times to create the walls of varying width.

Innerduct 40 is provided with pull lines 54, 55 and 56, in compartments 41, 42 and 43, respectively, for pulling cables through the innerduct.

A single innerduct 40 is shown in a conduit 53, but it should be understood that multiple innerducts like the innerduct 40 may be inserted in a conduit, depending on the diameter of the conduit. For example, it is contemplated that three such innerducts can be inserted in a 4" diameter conduit, thus providing nine channels for the insertion of fiber optic cable. By way of example, if conduit 53 has an inner diameter of 4" and the strip-shaped length of fabric 45 (in the center of innerduct 40) is 3" wide, the width of the narrowest wall is less than the inner diameter of the conduit 53. This helps to minimize frictional engagement of the innerduct 40 with the conduit 53 when the innerduct is being pulled through the conduit.

It can be understood that while the shared-walled configuration of the innerduct is shown with walls that are biased to maintain the compartments in an open position, the shared wall configuration may be constructed with the walls having approximately the same width. In the latter case, the innerduct will lie flat and the advantage of the present invention, that is, low rigidity in the filling direction of the innerduct, is especially useful in facilitating the insertion of a cable into the innerduct.

Pull Lines

To draw the fiber optic, coaxial, or other cables through the innerduct structure, it is desirable to provide pull lines for such purpose. The pull lines are positioned within the compartments of the innerduct, preferably before installation of the innerduct within the conduit. By way of example, the pull lines may be tightly woven, relatively flat strips of material or may be a twisted ropes or multi-ply cords having a substantially round cross-section.

Preferably, the innerduct and the pull line have respective values of elongation percentage which are substantially equal for a given tensile load. If elongation of the innerduct differs substantially from that of a pull line, one of those structures may lag relative to the other when they are pulled together through a conduit during installation, resulting in bunching of the innerduct. The pull lines may be formed of tightly woven, polyester material, which exhibits a tensile strength of between about 400 pounds and about 3,000 pounds.

Conduit

Generally, a conduit is a rigid or semi-rigid piping or duct system for protecting and routing cables, electrical wiring and the like. The term "cable" is intended to include fiber optic cables, electrical wires, coaxial and triaxial cables, as well as any other line for transmitting electricity and/or electromagnetic signals. By way of example, the conduit may be made of metal, synthetic polymer, such as thermoplastic polymer, clay or concrete. The passageway through the conduit may have a round, oval, rectangular or polygonal cross-section. The present invention finds utility in combination with virtually any conduit system. Depending upon the relative size of the passageway in the innerduct, typically calculated as the inside diameter, persons skilled in the art may select from the width of the innerduct, number of compartments in each innerduct, and number of individual innerducts, to maximize the capacity of the conduit.

EXAMPLES

The invention may be further understood with reference to the following examples.

Warp tensile strength was measured according to ASTM D5035 Standard Test Method for Breaking Force and Elongation of Textile Fabrics (Strip Test Method).

Filling tensile strength was measured according to ASTM D5035 Standard Test Method for Breaking Force and Elongation of Textile Fabrics (Strip Test Method).

Filling tear strength was measured according to ASTM D5034 Standard Test Method for Breaking Force and Elongation of Textile Fabrics (Grab Test Method).

Pulling tension was measured according to pounds force, as measured with a digital load cell, required to install two 18 mm OD fiber optic cables into an innerduct having a tear-drop configuration, with two compartments, and a width of 44 mm (corresponding to MaxCell® style 4418-2), located in a 50 mm ID PVC conduit over a distance of 225 meters, with two 90 degree sweep bends.

Seam strength was measured by ASTM D1683 Standard Test Method for Failure in Sewn Seams of Woven Apparel Fabrics.

Example 1

A textile fabric having the following characteristics was woven on a Dornier HTVS 4/S 220 cm machine. The multifilament polyester filling yarns were double. The fabric was finished, slit and sewn into a tear-drop configured innerduct structure, as shown in FIG. 3, with two compartments, corresponding to Milliken & Company MaxCell® style 4418-2.

Warp: 48 ends per inch of 520 denier PET monofilament yarn;

Filling: 18 picks per inch, in a six pick repeat (1) 520 denier nylon 6 monofilament yarn; (2) double insertion of 681 denier textured PET multifilament yarn (two-ply 300 denier/68 filaments; (3) double insertion of 681 denier textured PET multifilament yarn (two-ply 300 denier/68 filaments; (4) 350 denier nylon 6 monofilament yarn; (5) double insertion of 681 denier textured PET multifilament yarn (two-ply 300 denier/68 filaments; and (6) double insertion of 681 denier textured PET multifilament yarn (two-ply 300 denier/68 filaments. The weight of the fabric was 5.8 oz per square yard.

The layout of the filling yarn is shown in FIG. 5. The abbreviations appearing in FIG. 5 are identified as follows:

N6=nylon 6

PET=polyethylene terephthalate

PPI=picks per inch

DI=double-inserted

Example 2—Comparative

A textile fabric and innerduct structure similar to Example 1 were constructed, except that a single 1100 denier textured PET multifilament yarn (192 filaments/single ply) was substituted for the two, double-inserted 681 denier multifilament PET yarn in the textile fabric. The weight of the fabric was 5.5 oz per square yard.

The layout of the filling yarn is shown in FIG. 5.

Test Results

Each of the textile fabrics of Example 1 and 2 was made into a tear-drop shaped innerduct having substantially the proportions shown in FIG. 2. The performance of the innerducts made from the respective fabrics was tested according to the methods set forth above, and the results are reported in Table 1 below.

TABLE 1

| Test | Example 1 | Example 2-Comparative |
|---|---|---|
| Warp Tensile | 579 lb/in$^2$ | 584 lb/in$^2$ |
| Filling Tensile | 352 lb/in$^2$ | 394 lb/in$^2$ |
| Filling Tear | 302 lb/in$^2$ | 226 lb/in$^2$ |
| Pulling Tension (maximum) | 180 lbs | 229 lbs |
| Seam Strength | 126 lbs | 104 lbs |

The innerduct constructed from the fabric of Example 2 (comparative) showed a 27% increase in pulling tension, relative to the innerduct constructed from the fabric of Example 1 (present invention). The difference in pulling tension correlates to the reduction in the rigidity in the filling direction of the fabric. The results were achieved despite the fact that the fabrics compared double-insertion of 681 denier multifilament yarn (2×681d) to a single 1,000 denier multifilament yarn. Thus, contrary to the expectation that increasing the yarn denier, for example to achieve strength and stability of the fabric, increases the rigidity of the fabric, the present invention demonstrates that the rigidity of the fabric decreases (improves) as a result of multiple insertions of individual yarns in the filling direction, without compromising other product parameters. It is also important to note that seam strength was significantly better in Example 1.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein may be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What I claim is:

1. An innerduct for a cable, comprising one or more strip-shaped lengths of woven textile fabric configured to create a flexible, longitudinal compartment for enveloping a cable, wherein the woven textile fabric is in a plain weave construction and comprises:

a plurality of warp yarns, wherein the warp yarns are monofilament warp yarns, and wherein the warp yarns have a warp crimp of less than 5%, as measured by ASTM D3883-Standard Test Method for Yarn Crimp and Yarn Take-Up in Woven Fabrics; and, a plurality of filling yarns interwoven with the warp yarns, wherein the filling yarns consist of a repeating pattern of picks of monofilament yarns and multiple-inserted multifilament yarns, wherein the multifilament yarns contain between 30 and 110 individual filaments, wherein the arrangement of monofilament yarns to multiple-inserted multifilament yarns is selected from the group consisting of 1:1, 1:2, 1:3, 2:3, 3:4, and 3:5, wherein at least one-fourth of the picks of the filling yarns are multiple-inserted multifilament yarns, and wherein the multiple-inserted multifilament yarns pass successively over and under every warp yarn together.

2. The innerduct of claim 1, wherein the filling comprises from 14 to 22 picks per inch and the warp comprises from 25 to 75 ends per inch of polyester, monofilament yarn.

3. The innerduct of claim 1, wherein the multiple-inserted multifilament yarns are textured, polyester, multifilament yarns.

4. The innerduct of claim 1, wherein the one or more strip-shaped lengths of woven textile fabric are configured to create at least two flexible, longitudinal compartments for enveloping cables, and each of the compartments contains a pull line.

5. The innerduct of claim 1, wherein the innerduct is configured from a single, strip-shaped length of woven textile fabric folded to create a unitary structure having one or more flexible, longitudinal compartments, with each of the compartments configured for enveloping a cable, and wherein the textile fabric has side edges, which are folded over and sewn together.

6. The innerduct of claim 1, wherein the multiple-inserted multifilament yarns are double-inserted multifilament yarns.

7. An apparatus comprising:

(a) a conduit;

(b) one or more strip-shaped lengths of woven textile fabric configured to create a flexible, longitudinal compartment for enveloping a cable, wherein the woven textile fabric is in a plain weave construction and comprises:

a plurality of warp yarns, wherein the warp yarns are monofilament warp yarns, and wherein the warp yarns have a warp crimp of less than 5%, as measured by ASTM D3883-Standard Test Method for Yarn Crimp and Yarn Take-Up in Woven Fabrics; and, a plurality of filling yarns interwoven with the warp yarns, wherein the filling yarns consist of a repeating pattern of picks of monofilament yarns and multiple-inserted multifilament yarns, wherein the multifilament yarns contain between 30 and 11 individual filaments, wherein the arrangement of monofilament yarns to multiple inserted multifilament yarns is selected from the group consisting of 1:1, 1:2, 1:3, 2:3, 3:4, and 3:5 wherein at least one-fourth of the picks of the filling yarns are multiple-inserted multifilament yarns, and wherein the multiple-inserted multifilament yarns pass successively over and under every warp yarn together; and (c) a cable positioned in the longitudinal compartment.

8. The apparatus of claim 7, wherein the one or more strip-shaped lengths of woven textile fabric are configured to create at least two flexible, longitudinal compartments for enveloping cables.

9. The apparatus of claim 7, wherein the multiple-inserted multifilament yarns are double-inserted multifilament yarns.

* * * * *